US006962301B1

(12) United States Patent
Chang

(10) Patent No.: US 6,962,301 B1
(45) Date of Patent: Nov. 8, 2005

(54) FRONT-LIFTING WASTEBASKET FOR PAPER SHREDDER ALSO SERVED AS GARBAGE BIN

(75) Inventor: Frank Chang, SanChung (TW)

(73) Assignee: Michilin Prosperity Co., Ltd., Taipei Hsien (TW)

( * ) Notice: Subject to any disclaimer, the term of this patent is extended or adjusted under 35 U.S.C. 154(b) by 0 days.

(21) Appl. No.: 10/866,144

(22) Filed: Jun. 14, 2004

(51) Int. Cl.[7] ..... B02B 7/02; B02C 7/14
(52) U.S. Cl. ..... 241/100; 241/236
(58) Field of Search ..... 241/100, 236; 206/216; 220/908

(56) References Cited

U.S. PATENT DOCUMENTS 2,970,533 A * 2/1961 Allen ..... 100/226
4,637,560 A * 1/1987 Goldhammer ..... 241/100
5,035,366 A * 7/1991 Hashimoto et al. ..... 241/36
5,421,252 A * 6/1995 Reichel ..... 100/193
6,079,645 A * 6/2000 Henreckson et al. ..... 241/37.5
6,193,091 B1 * 2/2001 Olivetti ..... 220/23.88
6,276,553 B1 * 8/2001 Vulcano ..... 220/495.06
6,708,607 B1 * 3/2004 Schwelling ..... 100/35

* cited by examiner

*Primary Examiner*—Derris H. Banks
*Assistant Examiner*—Faye Francis
(74) *Attorney, Agent, or Firm*—Dennison, Schultz, Dougherty and MacDonald

(57) ABSTRACT

This invention relates to a front-lifting wastebasket for paper shredder also serving as garbage bin, having: a conventional strip-cut paper shredder or cross-cut paper shredder; an injection molded wastebasket, the wastebasket including: a base, an outer bin, and a front-lifting inner bin, wherein the inner bin is received in an open space defined by the outer bin, whereby not only can the wastebasket serve as a wastebasket for containing paper shreds after the paper shredder shreds paper, but may also be lifted outwards to serve as a conventional garbage bin, so as to improve the market competitiveness of the paper shredder by enhancing the functions of the wastebasket.

1 Claim, 3 Drawing Sheets

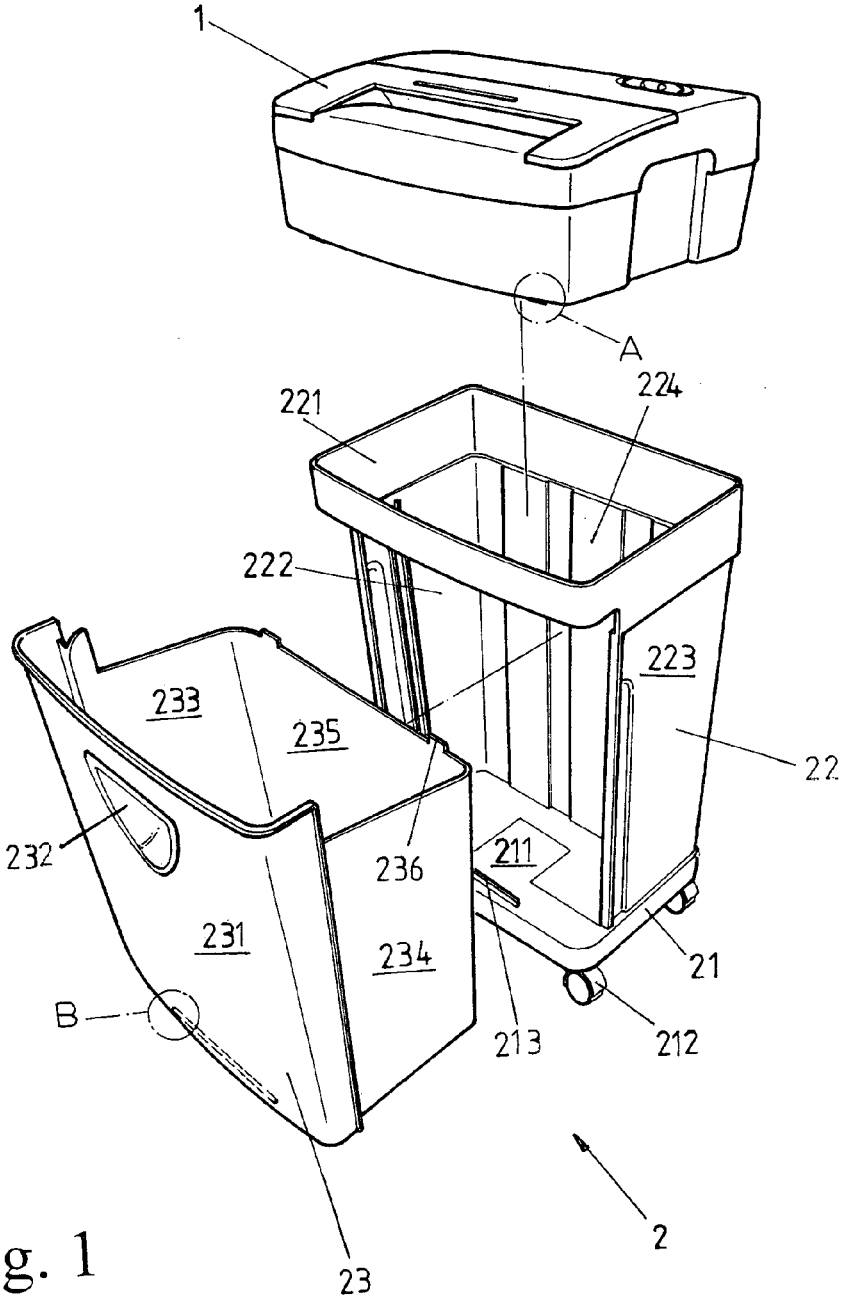
Fig. 1
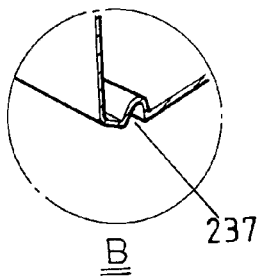
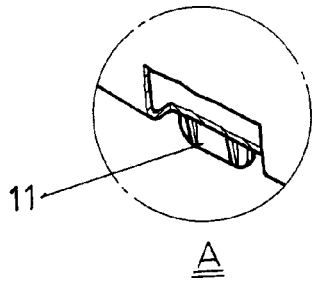

FRONT-LIFTING WASTEBASKET FOR PAPER SHREDDER ALSO SERVED AS GARBAGE BIN

FIELD OF INVENTION

This invention relates to an improved paper shredder wastebasket, particularly to one that may not only serve as a wastebasket for containing paper shreds after the paper shredder shreds paper, but also be lifted outwards to serve as a conventional garbage bin.

BACKGROUND OF INVENTION

U.S. Pat. No. 5,269,473 disclosed a support structure for a paper shredder that is made into a platform for supporting a paper shredder by bent sheet steels. The platform is provided in a space within an open stand located there beneath with a forwardly-projecting pocket that forms a collector with an opening. Not only may the collector serve to contain waste paper shreds, a user may also pitch in garbage in general through the opening formed by the forwardly-projecting pocket.

Such prior art involves the shortcomings that the paper shredder, support structure and the collector are independent units, but not an integral design so as to impair its overall appearance. Products of such a kind have less competitive edges in view of the increasingly competitive market.

SUMMARY OF INVENTION

In view of the above, the inventor made improvements to the conventional wastebasket for paper shredder to obtain a front-lifting paper shredder wastebasket that would eliminate the above shortcomings after researches and trials.

The objective of this invention is to provide a front-lifting paper shredder wastebasket that may not only serve as a wastebasket for containing paper shreds after the paper shredder shreds paper, but also be lifted outwards to serve as a conventional garbage bin, so as to improve the market competitiveness of the paper shredder by enhancing the functions of the wastebasket.

To achieve the objective, this invention discloses a front-lifting wastebasket for paper shredder also serving as garbage bin, comprising: a conventional strip-cut paper shredder or cross-cut paper shredder; an injection molded wastebasket, the wastebasket including: a base, an outer bin, and a front-lifting inner bin, wherein the inner bin is received in an open space defined by the outer bin, whereby not only can the wastebasket serve as a wastebasket for containing paper shreds after the paper shredder shreds paper, but may also be lifted outwards to serve as a conventional garbage bin, so as to improve the market competitiveness of the paper shredder by enhancing the functions of the wastebasket.

BRIEF DESCRIPTION OF THE DRAWINGS

These and other modifications and advantages will become even more apparent from the following detained description of a preferred embodiment of the invention and from the drawings in which:

FIG. 1 is an exploded, perspective view of a front-lifting wastebasket according to this invention;

DETAILED DESCRIPTION OF THE INVENTION (PREFERRED EMBODIMENTS)

Figure 2:
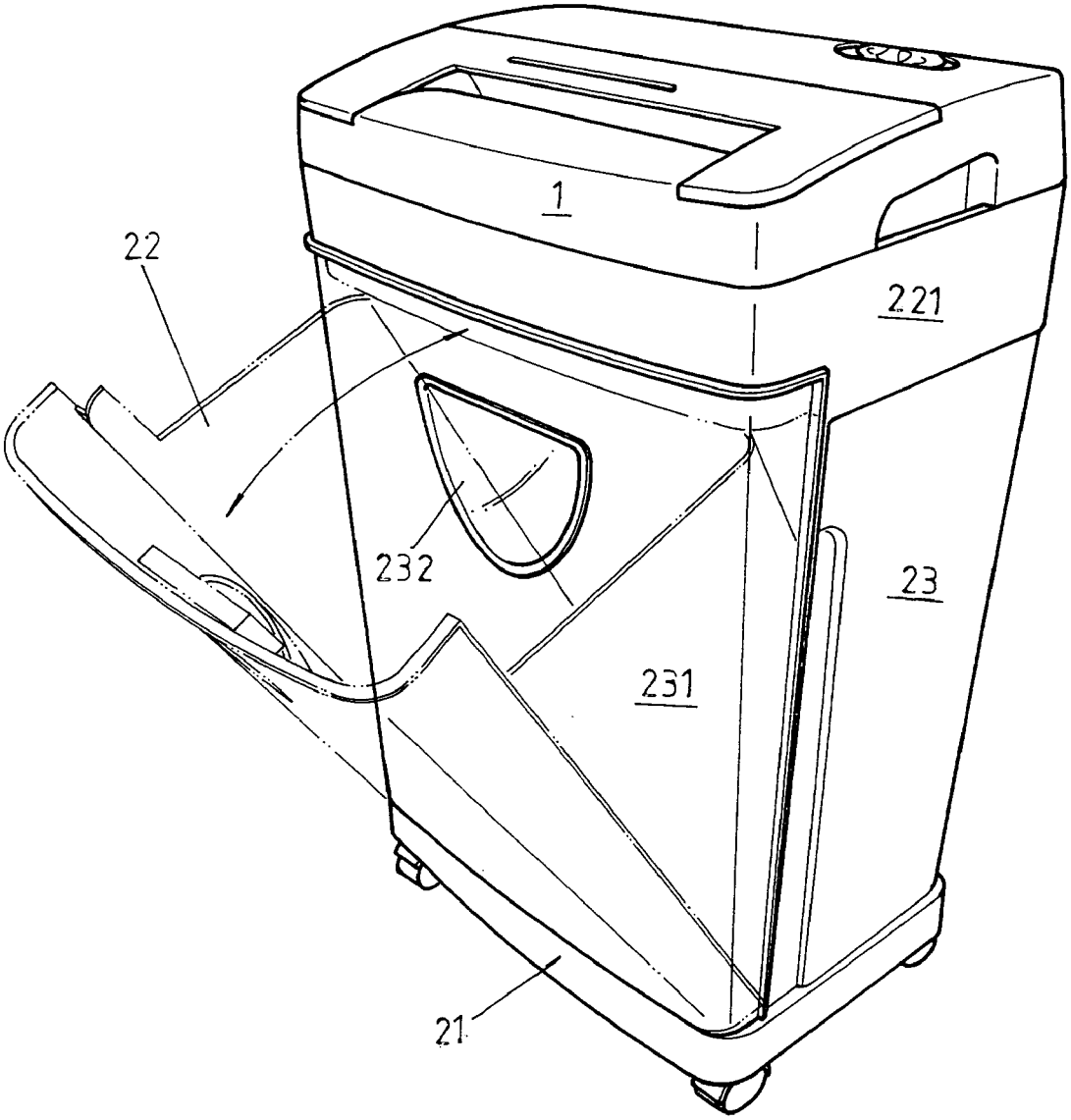
FIG. 2 is schematic view illustrating the front-lifting wastebasket of this invention in use.
Figure 3:
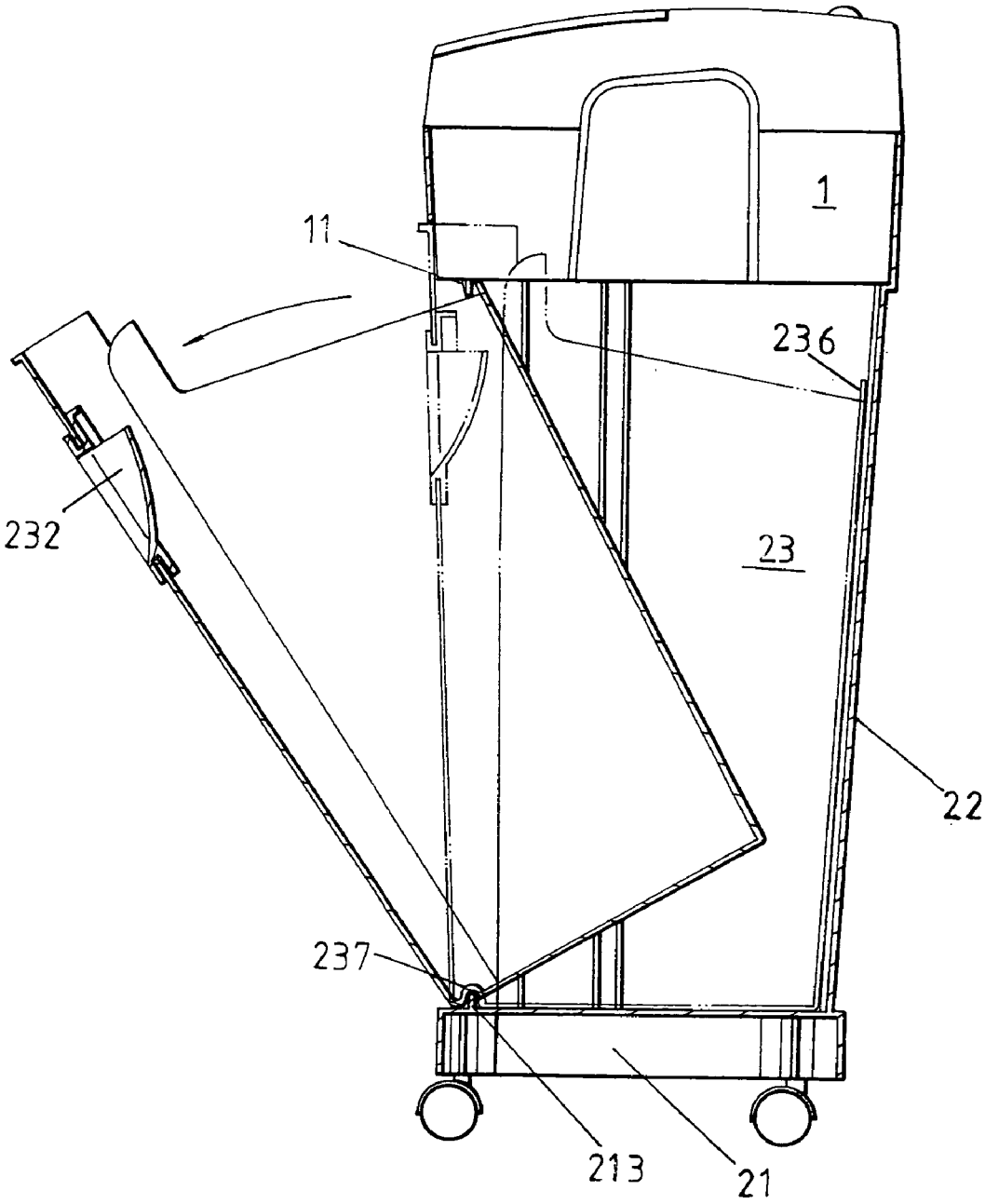
FIG. 3 is a cross-sectional view illustrating the front-lifting wastebasket of this invention in use.

With reference to FIGS. 1 to 3, in which FIG. 1 illustrates an exploded, perspective view of a front-lifting wastebasket according to this invention; FIGS. 2 and 3 are schematic view and cross-sectional view illustrating the front-lifting wastebasket of this invention in use, respectively.

This invention comprises a paper shredder 1 for shredding paper; and a wastebasket 2 for containing paper shreds. The paper shredder may be a conventional strip-cut paper shredder or cross-cut paper shredder. At opposing sides of a bottom front edge of the paper shredder are each provided with a downwardly-projecting tab 11 (as illustrated in an enlarged view in sub-figure A). The wastebasket 2 includes an injection molded base 21, an outer bin 22 and an inner bin 23, wherein:

The base 21 is provided at a front side thereof with a platform 211, casters 212 provided at each of four bottom corners, and a crosswise rib 213 at a bottom front edge thereof.

The outer bin 22 is a hollow bin body that is formed on at top thereof with a rectangular stand 221 for supporting the paper shredder 1. The outer bin includes a left-side wall 222, a right-side wall 223 and a rear wall 224 extending downwards from the stand 221 and located above the platform 211. A front of the outer bin is formed with a hollow-out opening to define an open space for containing the inner bin 23, described in detail as follows.

The inner bin 23 is provided at a top center of a front panel 231 thereof with a recessed grip 232. The inner bin includes a left-side wall 233 and a right-side wall 234 that incline towards a rear wall 235 from the front panel 231 to assume a rearward inclining configuration as shown in FIG. 3. The rear wall 235 is provided on each of the opposing sides of an upper edge thereof, at locations that correspond to the tabs 11 projecting downwards from the bottom edge of the paper shredder 1 with an upwardly-projecting retaining tab 236. The inner bin is provided at a bottom thereof, at a location corresponding to the crosswise rib 213 provided at the bottom front edge of the base with an elongated groove 237 (as illustrated in an enlarged view in sub-figure B).

With reference to FIGS. 2 and 3, after placing the inner bin 23 in the hollow bin body of the outer bin 22, the elongated groove 237 of the inner bin 23 adapts to engage the crosswise rib 213 at the bottom front edge of the base. Upon activating the paper shredder 1, shredded paper fragments happen to fall into the hollow bin body. After a user pulling the recessed grip 232 provided at the front panel of the inner bin 23 outwards, the inner bin 23 would pivot about where the elongated groove 237 of the inner bin 23 engages the crosswise rib 213 and then be lifted outwards, while the retaining tabs 236 projecting upwards from the rear wall 235 of the inner bin 23 would be retrained by the tabs 11 projecting downwards from the bottom front edge of the paper shredder 1 to prevent further front-lifting of the inner bin 23, to form an opening through which conventional garbage may be pitched, whereby not only can the inner bin not only serve as a wastebasket for the paper shredder, but may also be lifted outwards to serve as a conventional garbage bin.

The elongated groove of the inner bin, the crosswise rib provided at the bottom front edge of the base, the recessed grip, the retaining tabs projecting upwards from the rear wall of the inner bin and the tabs projecting downwards from the bottom edge of the paper shredder as described in the above embodiment may all be modified into other configurations and provided at alternate locations with equivalent effects in actual practice. For example, the locations of the elongated groove of the inner bin and the crosswise rib provided at the bottom front edge of the base may be switched while the pivoting effect achieved by their inter-engagement to allow the front-lifting of the inner bin remains unchanged. Furthermore, the recessed grip may also be replaced with the conventional grip that is commonly provided to a desk drawer while achieving the same effect for pulling the inner bin outwards. Furthermore, the locations of the retaining tabs projecting upwards from the rear wall of the inner bin and the tabs projecting downwards from the bottom edge of the paper shredder are not limited to be at the respective opposing sides, but at corresponding center locations. Thus, this invention is not limited to the embodiments as described above.

In summary, this invention provides an improved paper shredder wastebasket that may not only serve as a wastebasket for containing paper shreds after the paper shredder shreds paper, but also be lifted outwards to serve as a conventional garbage bin, so as to improve the market competitiveness of the paper shredder by enhancing the functions of the wastebasket.

LISTING OF NOMENCLATURES

1 paper shredder
2 wastebasket
11 tab
21 base
22 outer bin
23 inner bin
211 platform
212 casters
213 crosswise rib
221 stand
222 left-side wall
223 right-side wall
224 rear wall
231 front panel
232 grip
233 left-side wall
234 right-side wall
235 rear wall
236 retaining tabs
237 elongated groove

What is claimed is:

1. A front-lifting wastebasket for paper shredder also serving as garbage bin, comprising: a conventional strip-cut paper shredder or cross-cut paper shredder; an injection molded wastebasket, characterized in that:

the paper shredder is provided at a bottom thereof with at least one downwardly-projecting tab;

the wastebasket includes: a base, an outer bin, and a front-lifting inner bin, wherein:

the base is provided at a front side thereof with a platform, and a crosswise rib at a bottom front edge thereof;

the outer bin is a hollow bin body that is formed on at top thereof with a rectangular stand for supporting the paper shredder, the outer bin including a left-side wall, a right-side wall and a rear wall extending downwards from the stand and located above the platform, a front of the outer bin being formed with a hollow-out opening to define an open space for containing the inner bin;

the inner bin is provided on a front panel thereof with a grip, the inner bin including a left-side wall and a right-side wall that incline towards a rear wall from the front panel to assume a rearward inclining configuration, the rear wall being provided on an upper edge thereof, at a location that corresponds to the tab projecting downwards from the bottom of the paper shredder with at least one upwardly-projecting retaining tab, and the inner bin being provided at a bottom thereof, at a location corresponding to the crosswise rib provided at the bottom front edge of the base with an elongated groove.

* * * * *